US005881416A

United States Patent [19]

Moore et al.

[11] Patent Number: 5,881,416

[45] Date of Patent: Mar. 16, 1999

[54] PAPER CLEANING SYSTEM

[76] Inventors: Burnis E. Moore, 3645 Schreiner Rd., Dowling, Mich. 49050; William H. Shippy, 3667 W. Surrey La., Fort Gratiot, Mich. 48059

[21] Appl. No.: 968,102

[22] Filed: Nov. 12, 1997

Related U.S. Application Data

[60] Provisional application No. 60/031,337 Nov. 20, 1996.

[51] Int. Cl.[6] ..... B08B 1/02

[52] U.S. Cl. ..... 15/3; 15/102

[58] Field of Search ..... 15/3, 100, 102, 15/104.002

[56] References Cited

U.S. PATENT DOCUMENTS 3,641,605 2/1972 Lindsay ..... 15/100
4,858,265 8/1989 Suzuki et al. ..... 15/100
5,699,584 12/1997 Wieloch et al. ..... 15/256.52
5,813,073 9/1998 Korbonski ..... 15/3

FOREIGN PATENT DOCUMENTS 1077960 11/1957 Germany ..... 15/104.002

*Primary Examiner*—Mark Spisich
*Assistant Examiner*—Andrew Aldag
*Attorney, Agent, or Firm*—Young & Basile, P.C.

[57] ABSTRACT

Apparatus for cleaning a moving web, such as paper, paper board or cardboard, prior to printing or processing wherein a tacky wiper cloth engages the moving web to collect contaminating particles. The wiper collection surface is renewable and the apparatus firmly holds the wiper in contact with the web yet is releasable during web threading procedures.

16 Claims, 4 Drawing Sheets

PAPER CLEANING SYSTEM

CROSS REFERENCE TO CO-PENDING APPLICATION

This application claims the benefit of U.S. Provisional application Ser. No. 60/031,337 filed Nov. 20, 1996.

BACKGROUND OF THE INVENTION

1. Field of the Invention

The invention pertains to moving web cleaning apparatus, particularly suitable for cleaning moving paper, paper board and cardboard webs prior to printing for removing dust shavings and loose and embedded contaminants from substrate surfaces.

2. Description of the Related Art

During the manufacture or processing of moving substrate surfaces such as webs of paper, paper board, cardboard, fabric and the like, the surface of the web will pick up dust, fiber particles, slitter shavings, scrapings, and other loose or embedded contaminants. If the webs are to be printed, painted or otherwise coated, such surface contaminants will interfere with the coating process significantly reducing the printing or coating quality, resulting in rejects. Accordingly, it is highly desirable to clean the surface of webs prior to subsequent processing, such as printing, in order to achieve the highest quality.

In the past, webs have been cleaned by blasts of air, vacuum, vibration, or other processes such as shown in U.S. Pat. Nos. 3,105,256 ; 4,982,469; and 5,349,714. However, prior web cleaning systems have not achieved the efficiency and quality desirable as needed to consistently produce excellent printed surfaces, such as used in the packaging art, box making and the like wherein printing standards are high.

The most common web cleaning apparatus utilizes jets of air or vacuum to dislodge loose contaminants from the web substrate, but many particles are sufficiently embedded in the web as to not be removable by this means.

It is known to clean surfaces, such as fabric, clothing and the like, by using a tacky material, as shown in U.S. Pat. Nos. 2,624,060 and 2,755,494, and while such tacky cleaning surfaces are capable of effectively picking up lint, dust and the like, the efficiency of the cleaning device diminishes with usage as the tacky surface becomes covered with the loose particles being picked up eventually rendering the tacky material incapable of functioning.

Previously, web cleaning apparatus capable of high speed production has not been available for effectively cleaning rapidly moving webs using a wiping technique wherein the engagement of the cleaning material with the web produces sufficient mechanical action to remove embedded contaminants.

OBJECTS OF THE INVENTION

It is an object of the invention to provide a web cleaning system capable of efficiently cleaning moving webs of loose and embedded contaminants by a mechanical wiping action.

Another object of the invention is to provide a web cleaning system for moving webs wherein loose and embedded contaminants may be effectively removed wherein subsequent web printing and coating processes may occur producing excellent quality.

An additional object of the invention is to provide a moving web cleaning system which does not smear, stain or scratch the web substrate surface.

Another object of the invention is to provide a moving web cleaning system capable of upgrading low grade web substrate stock to a higher printable grade and wherein frequency of maintenance is reduced while the quality of the cleaning process is improved over prior systems.

SUMMARY OF THE INVENTION

The web cleaning system of the invention employs an elongated frame extending across the width of the moving web. The frame includes a support for a cotton cloth which has been treated with a resin compound such that the cloth is tacky and capable of picking up and retaining contaminants present on the web surface by a wiping action. This mechanical wiping action produced by the movement of the web and the engagement of the wiper cloth with the web surface effectively removes fiber particles, dust, slitter thread cuttings, clay coating scabs, calendar scrapings and similar contaminants from the web surface.

As the contaminants are retained by the resin impregnated cloth, the effectiveness of the cleaning action will be reduced as the cloth becomes "dirtier". In order to maintain the efficiency of the web cleaning system, the resin impregnated cloth is in the form of a dispensing roll whereby rolling out of the cloth permits a "new" tacky cloth wiper to be presented to the web and thereby maintain the efficiency and effectiveness of the apparatus even as it picks up contaminants. The quick renewing of the tacky cloth permits continued efficiency of the cleaning operation.

To ensure that the moving web and tacky wiper cloth are effectively engaged, the apparatus employs a movable platen for "opening and closing" the apparatus and maintaining the web in engagement with the tacky cloth. This movement of the apparatus platen simplifies installation of the tacky cloth, and also provides a backing for the web when engaged by the wiper cloth.

The web cleaning system of the invention is highly effective due to the mechanical engagement of the web and wiper cloth, as compared with air blast or vacuum systems for removing contaminants from moving webs, and use of the invention permits lower grade substrate to be used in situations where, previously, a higher grade paper product was required, such as in the printing of food cartons and the like. Carton waste is reduced, and fewer cleaning cycles are required as compared to previous web cleaning systems.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
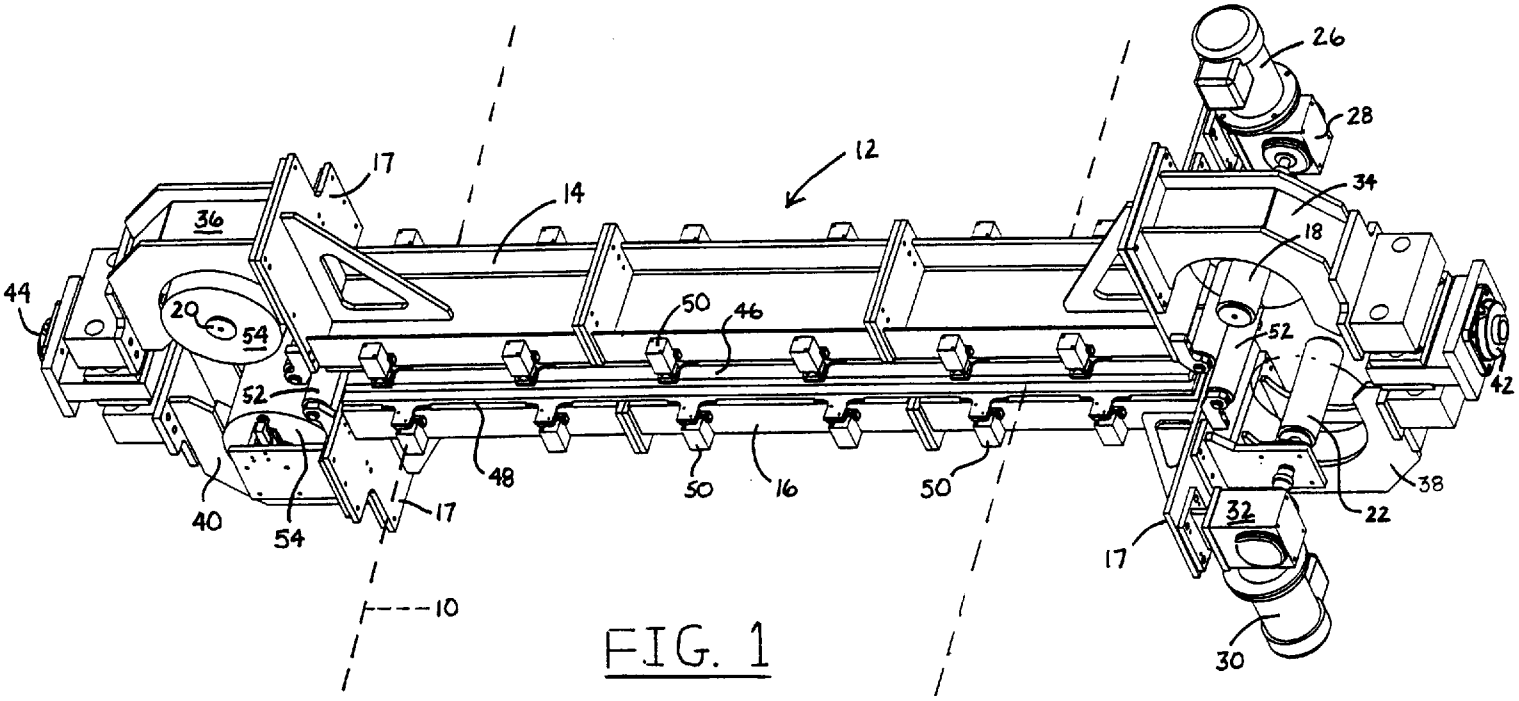
FIG. 1 is a perspective view of web cleaning apparatus in accord with the invention.
Figure 3:
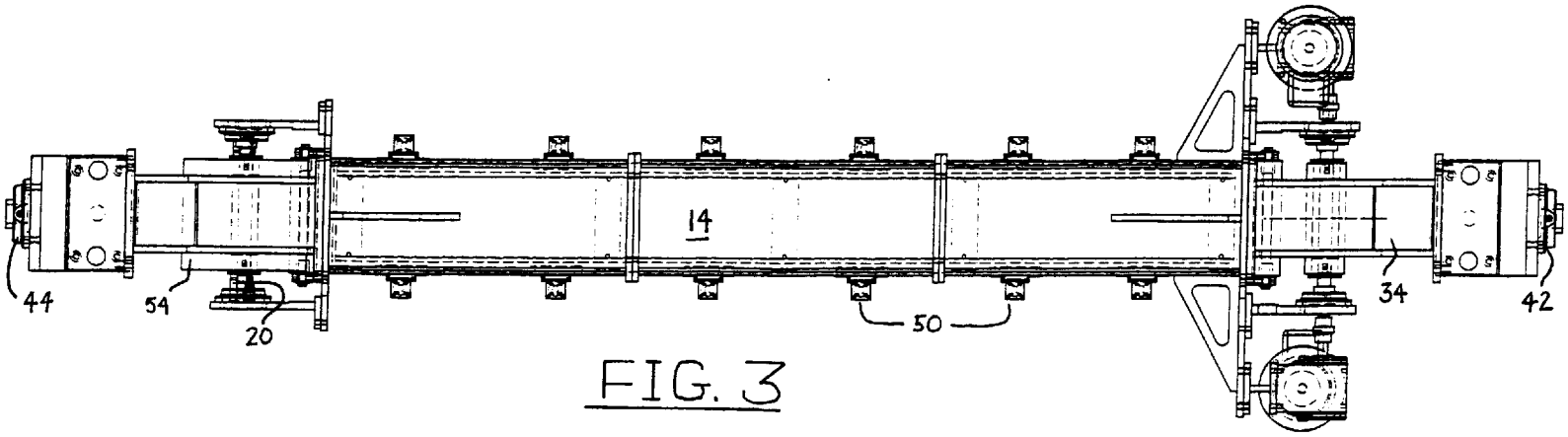
FIG. 3 is a plan view.

With reference to FIG. 1, the web to be cleaned by the apparatus of the invention is schematically represented by dotted lines at 10. This web may be of paper, paper board, cardboard, fabric, or the like and is passing over drive and idle rollers prior to being further processed, for instance printed or otherwise coated. The web 10, for instance a paper or paper board web which is printed prior to being formed into boxes or cartons, will often have dust, fiber particles, slitter shavings, scrapings, and other loose or embedded contaminants located upon the web surface, and such foreign matter will adversely affect the quality of printing operations. The apparatus of the invention, the cleaning apparatus 12, removes such contaminants from the web surface, and the cleaning apparatus 12 is located within the path of movement of the web to clean the web prior to printing or coating operations.

The cleaning apparatus 12 spans the web 10 and includes an upper elongated bridge 14 and a lower bridge 16 disposed immediately below the bridge 14.

A mounting bracket 17 is mounted upon each end of each bridge, and the upper bridge 14 includes a rotatable take-up shaft 18 while the left end of the bridge 14, FIG. 1, supports a rotatable dispenser shaft 20. In a similar manner, the lower bridge 16 includes a take-up shaft 22 at a location below the shaft 18, and the bridge 16 also includes a rotatable dispenser shaft 24 at its left end. An electric motor 26 drives the take-up shaft 18 through transmission 28, and electric motor 30 drives take-up shaft 22 through transmission 32.

As will be appreciated from the drawings, the shaft 18 is mounted within a housing 34 attached to bracket 17 while the dispenser shaft 20 of the bridge 14 is mounted within housing 36. In a similar manner, the housing 38 mounted upon the lower bridge 16 encloses the take-up shaft 22 while the dispenser shaft 20 is mounted within the housing 40.

The cleaning apparatus 12 is relatively heavy, and is supported in such a manner as to readily align the cleaning apparatus to the position of the web 10. Accordingly, the housings 34 and 38 support a centrally located journal 42, while the housings 36 and 40 support a second journal 44. The journals 42 and 44 may be mounted in acceptable bearing support structure, not shown, in order to position the cleaning apparatus 12 in a proper angular relationship to the web 10.

The upper bridge 14 supports a relatively flat platen 46 on its underside while a platen 48 is mounted upon the upper side of the lower bridge 16, the platens extending the length of the associated bridge. Hydraulic or air expansible chamber cylinders or motors 50 are disposed along the edges of the bridges 14 and 16 to support the platens 46 and 48 and permit the platens to be moved toward each other, or retracted away from each other, the operation of the cylinders 50 being described below.

Figure 2:
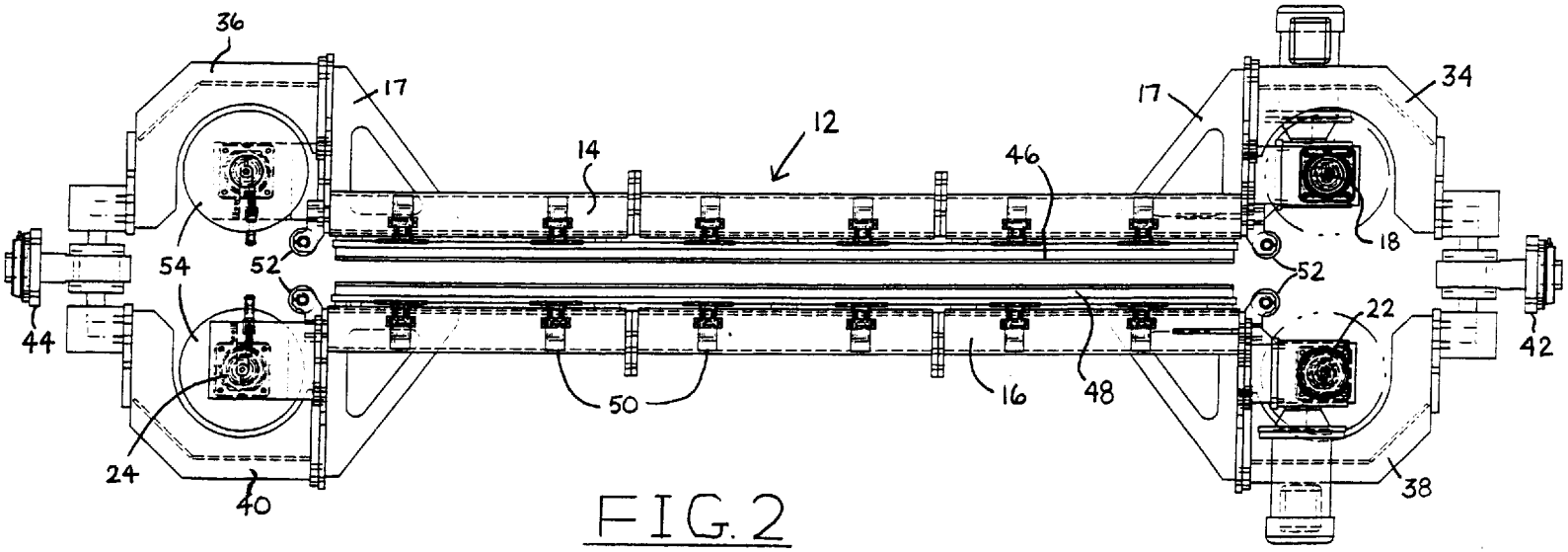
FIG. 2 is a side elevational view of the apparatus.
Figure 4:
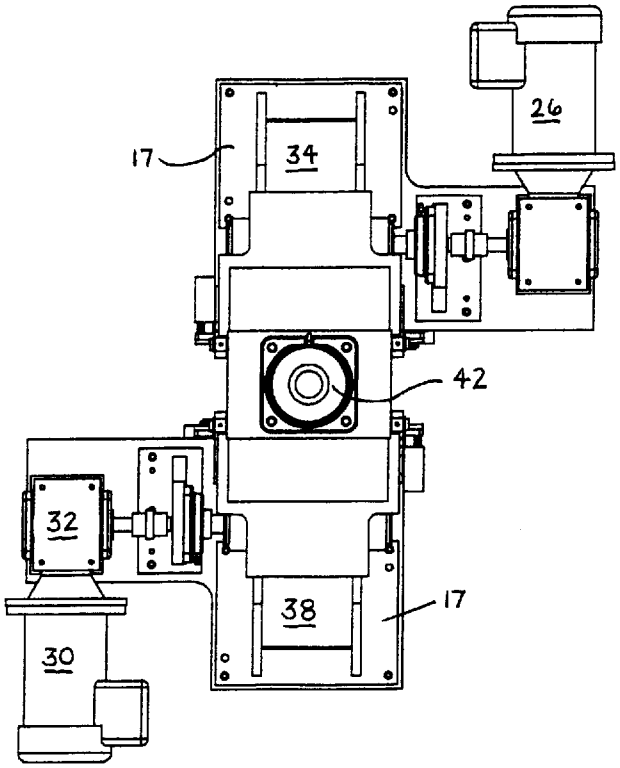
FIG. 4 is an end elevational view as taken from the right end of FIG. 2.

Tack cloth guide rollers 52 are mounted upon the bridge brackets 17, FIG. 2, each having an axis parallel to the direction of movement of the web 10, and the tack cloth passes around the rollers 52 as later described.

A roll of tack cloth indicated at 54 is mounted upon each of the dispenser shafts 20 and 24, FIG. 1. The tack cloth wound in the form of the roll 54 is preferably of a milled and woven 4-ply cotton that has been treated with a non-static, non-toxic resin compound. The resin compound is of a tacky character to which dust, fiber particles, shavings, scrapings and the like as may be encountered upon the surface of the web 10 will adhere.

In operation, the cleaning apparatus 12 will be oriented to the web 10 by pivoting of the cleaning apparatus on the journals 42 and 44 such that the platens 46 and 48 will be parallel to the web 10, and located upon opposite sides of the web. Initially, the cylinders 50 will be retracted wherein the platens 46 and 48 will be separated to the maximum extent and the web 10 may readily be fed between the platens.

The tack cloth being dispensed from the rollers 54 is located immediately adjacent the associated platen, i.e. the tack cloth on the roller 54 mounted upon the dispenser shaft 20 will be disposed immediately adjacent the upper platen 46, while the tack cloth roller 54 mounted upon the dispenser shaft 24 will be immediately adjacent the roller platen 48. The tack cloth dispensed from the rolls 54 passes around the guide rollers 52, and the upper tack cloth roller free end will be attached to the take-up shaft 18 while the lower tack cloth roller free end will be affixed to the take-up shaft 22 of the lower bridge 16.

The cleaning apparatus 12 disclosed in FIGS. 1–4 is designed to clean both sides of a moving web or substrate. Accordingly, as the web 10 moves through the cleaning apparatus 12, the web 10 will be engaged by the tack cloth adjacent both the platens 46 and 48 and the web surfaces will be wiped by the tack cloth. During the cleaning operation, the cylinders 50 will be actuated to move the platens 46 and 48 to their "closed" position wherein the platens will be located at their pre-adjusted minimal dimensional separation wherein the tack cloth will engage the web surfaces, but will not be sufficiently pressed against the web surfaces as to interfere with the movement of the web 10 through the apparatus 12. Accordingly, dust, fiber particles, shavings, scrapings and other contaminants located upon the web surfaces will be engaged by the tack cloth and will adhere to the tack cloth ensuring a clean web surface as the web surfaces leave the cleaning apparatus 12. This mechanical wiping of the web surfaces by the tack cloth is highly efficient in removing the type of particles normally found on a web 10 during manufacturing processes and a web surface cleaned by the apparatus of the invention is capable of receiving and retaining high quality printing and printed covering.

During the cleaning operation, the contaminants will adhere to the tack cloth engaging the web surfaces, and eventually, the contaminants will accumulate to an extent wherein the cleaning ability of the tack cloth will begin to become less effective. At such time, the movement of the web 10 is terminated, the cylinders 50 may be actuated to retract the platens 46 and 48 from each other, the motors 26 and 30 will be energized to rotate the shafts 18 and 22 winding up the "dirty" tack cloth upon the associated shafts and locating clean tack cloth dispensed from the rollers 54 adjacent the platens 46 and 48. The cylinders 50 may then be actuated to "close" the platens 46 and 48, the web 10 again begins to move and cleaning thereof occurs with the "new" tack cloth engaging the web.

The above procedure wherein the movement of the web 10 is terminated during renewal of the tack cloth is preferable, but in many installations it is not practical to stop the movement of the web 10, and in such instance, it is possible to quickly retract the platens 46 and 48, position a clean tack cloth adjacent the platens due to the rotation of the shafts 18 and 22, and close the platens. While such a procedure will permit a portion of the web 10 to pass through the cleaning apparatus 12 which has not been cleaned, the length of such portion will be relatively small, and the lack of cleaning of a small portion of the web is offset by the efficiencies of maintaining the web movement.

It is also possible to position a new tack cloth between the platens 46 and 48 by merely rotating the take-up shafts 18 and 22 during the normal cleaning operation. This procedure can be accomplished during movement of the web 10, and is permissible and desirable in some instances. However, if the friction between the tack cloth and the web 10 is sufficiently great, such lateral movement imposed on the web by the tack cloth movement may tend to displace the web 10 laterally in the cleaning apparatus 12. However, such lateral forces could be counteracted by rearranging the position of the shafts 18 and 22 wherein they are located at opposite ends of the cleaning apparatus whereby the tack cloth associated with the upper platen moves in the opposite direction than the tack cloth mounted within the lower platen.

In some instances, it is desirable to only clean one side of a web, for instance, the outer side of a paper web wherein cartons are to be manufactured of the web and only the outer side of the carton is to be printed and is desired to be free of contaminants. In such a situation, a single side of a web can be cleaned by apparatus such as shown in FIGS. 5 and 6.

Figure 6:
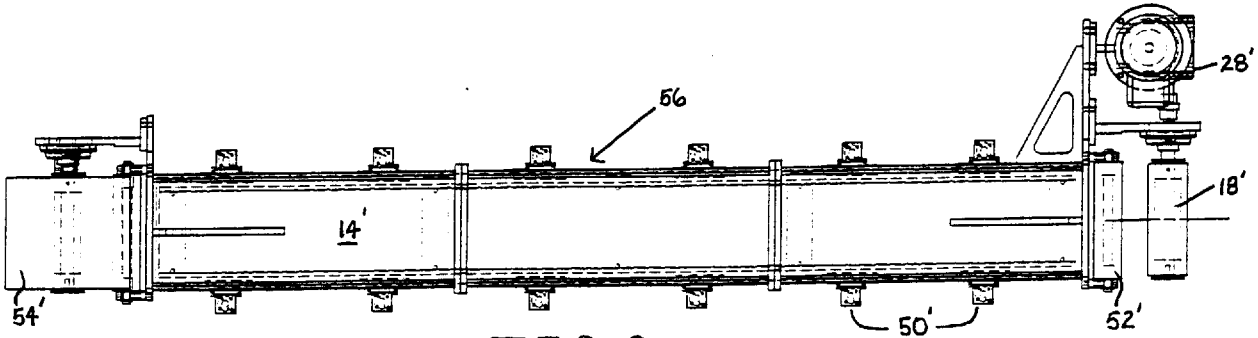
FIG. 6 is a plan view of the embodiment of FIG. 5.
Figure 5:
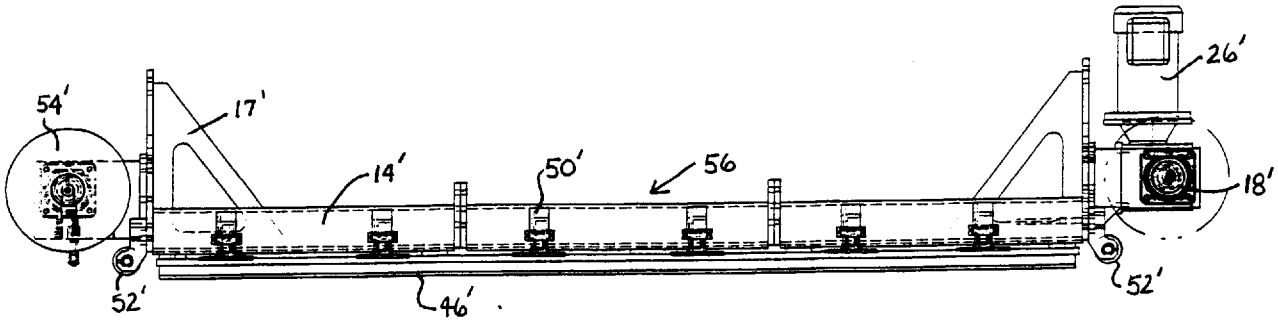
FIG. 5 is a side elevational view of a modification of web cleaning apparatus in accord with the invention.

The apparatus of FIGS. 5 and 6 is substantially identical to the upper bridge 14 of the previously described embodiment, and in the embodiment of FIGS. 5 and 6, components identical to those previously described are indicated by primes.

The cleaning apparatus 56 of FIGS. 5 and 6 is mounted upon web conveying and processing machinery wherein the bridge 14' and associated platen 46' will be located directly above the web surface to be cleaned. A flat surface, not shown, defined upon the web handling machinery will be located directly below the bridge 14' and platen 46' serving as a backing for the web as the upper side thereof is engaged by the tack cloth being dispensed from tack cloth reel 54'.

The operation of the embodiment of FIGS. 5 and 6 is identical to that previously described, and it will be appreciated that the apparatus of FIGS. 5 and 6 is capable of operating at the same high efficiency as the previously described embodiment wherein both sides of a web are cleaned.

It is appreciated that various modifications to the inventive concepts may be apparent to those skilled in the art without departing from the spirit and scope of the invention.

What is claimed is:

1. Apparatus for cleaning a web of indeterminate length having a width and moving in the direction of the web length comprising, in combination, a bridge assembly comprising an elongated bridge extending across the width of the moving web, said bridge having a web cleaner dispensing end and a web cleaner receiving end, a tacky web cleaner extending between the web and said bridge between said bridge ends in engagement with the moving web, web cleaner dispensing means located adjacent said bridge dispensing end and web cleaner receiving means located adjacent said bridge receiving end such that the tacky web cleaner is aligned and capable of moving transversely with respect to the direction of travel of the web.

2. In an apparatus for cleaning a web as in claim 1, a web cleaner backing platen defined on said bridge extending between said bridge ends, said platen engaging said web cleaner and maintaining said web cleaner in engagement with the web.

3. In an apparatus for cleaning a web as in claim 1, said web cleaner comprising an elongated strip of tacky material.

4. In an apparatus for cleaning a web as in claim 3, said web cleaner comprising a fabric tack cloth.

5. In an apparatus for cleaning a web as in claim 4, said tack cloth being in the form of a spirally wound roll from which tack cloth is dispensed, said web cleaner dispensing means comprising a tack cloth roll dispenser mounted at said bridge web cleaner dispensing end and said web cleaner receiver means comprising a tack cloth feed roll mounted at said bridge web cleaner receiving end winding used tack cloth thereon, and a motor operatively connected to said tack cloth feed roll.

6. In an apparatus for cleaning a web as in claim 2, motor operated support means mounting said backing platen on said bridge whereby operation of said support means controls the position of said backing platen relative to said bridge and engagement of said web cleaner with the web.

7. In an apparatus for cleaning a web as in claim 6 wherein said support means comprise expansible chamber motors.

8. In an apparatus for cleaning a web as in claim 1 wherein the web includes first and second sides, a first bridge assembly disposed adjacent the web first side, and a second bridge assembly disposed adjacent the web second side.

9. In an apparatus for cleaning a web as in claim 8, said first and second bridge assemblies being mounted upon support structure, and bearings supporting said support structure for rotating adjustment perpendicular to the web length.

10. Apparatus for cleaning a web of indeterminate length having first and second sides, lateral edges defining the web width and the web moving in the direction of the web length, comprising, in combination, a pair of mounting brackets located adjacent opposite web lateral edges, first and second elongated parallel bridges supported by and extending between said mounting brackets, a backing platen mounted on each bridge in opposed relationship to each other, first and second web cleaner dispensers mounted upon one of said mounting brackets, first and second web cleaner receivers mounted upon the other of said mounting brackets, a first tacky web cleaner being dispensed from said first dispenser adjacent said first bridge platen and received upon said first web cleaner receiver, a second tacky web cleaner being dispensed from said second dispenser adjacent said second bridge platen and received upon said second web cleaner receiver, the web moving between said first and second tacky web cleaners whereby both sides of the web will simultaneously be cleaned by said web cleaners.

11. In an apparatus for cleaning a web as in claim 10, a bearing mounted on each of said mounting brackets supporting the associated bracket, each of said bearings having an axis of rotation, said bearings, axes of rotation being coincident and perpendicular to the web direction of movement.

12. In an apparatus for cleaning a web as in claim 10, movable backing platen mounting means mounting each platen upon its associated bridge, said platen mounting means being movable between extended and retracted positions whereby said web cleaner engages the web in said extended position and disengages the web in said retracted position.

13. In an apparatus for cleaning a web as in claim 12 wherein said backing platen mounting means comprising expansible chamber motors.

14. In an apparatus for cleaning a web as in claim 10, said web cleaner comprising an elongated strip of tacky material.

15. In an apparatus for cleaning a web as in claim 14, said web cleaner comprising a fabric tack cloth.

16. In an apparatus for cleaning a web as in claim 15, said tack cloth being in the form of a spirally wound roll from which tack cloth is dispensed, said first and second web dispensers each cleaner comprising a tack cloth roll dispenser mounted at a bridge web cleaner dispensing end and said first and second web cleaner receivers each comprising a tack cloth feed roll mounted at said bridge web cleaner receiving end for winding used tack cloth thereon, and a motor operatively connected to said tack cloth feed roll.

* * * * *